US006501041B1

(12) United States Patent
Burns et al.

(10) Patent No.: US 6,501,041 B1
(45) Date of Patent: Dec. 31, 2002

(54) DELIVERY POINT SEQUENCING MAIL SORTING SYSTEM WITH FLAT MAIL CAPABILITY

(75) Inventors: Gary P. Burns, Rockford, MI (US); Douglas E. Olson, Grand Rapids, MI (US)

(73) Assignee: Rapistan Systems Advertising Corp., Grand Rapids, MI (US)

( * ) Notice: Subject to any disclaimer, the term of this patent is extended or adjusted under 35 U.S.C. 154(b) by 0 days.

(21) Appl. No.: 09/629,007

(22) Filed: Jul. 31, 2000

Related U.S. Application Data

(60) Provisional application No. 60/146,689, filed on Aug. 2, 1999.

(51) Int. Cl.[7] ..... B07C 5/00
(52) U.S. Cl. ..... 209/584; 209/900
(58) Field of Search ..... 209/583, 584, 209/900; 198/465.1

(56) References Cited

U.S. PATENT DOCUMENTS

| | | | | | |
|---|---|---|---|---|---|
| 3,184,061 | A | * | 5/1965 | Levy | 209/584 |
| 3,757,939 | A | * | 9/1973 | Henig | 209/72 |
| 3,988,017 | A | | 10/1976 | Kyhl | 271/111 |
| 4,507,739 | A | | 3/1985 | Haruki et al. | 364/478 |
| 5,009,321 | A | * | 4/1991 | Keough | 209/3.1 |
| 5,263,300 | A | | 11/1993 | Plent et al. | 53/244 |
| 5,353,938 | A | | 10/1994 | LaGrange et al. | 209/584 |
| 5,385,243 | A | * | 1/1995 | Jackson et al. | 209/509 |
| 5,718,321 | A | | 2/1998 | Brugger et al. | 198/359 |
| 5,803,704 | A | | 9/1998 | Lazzarotti | 414/793.4 |
| 5,833,076 | A | | 11/1998 | Harres et al. | 211/51 |
| 5,857,830 | A | | 1/1999 | Harres et al. | 414/798.9 |
| 5,860,504 | A | | 1/1999 | Lazzarotti | 198/357 |
| 5,893,464 | A | | 4/1999 | Kiani et al. | 209/584 |
| 5,924,576 | A | | 7/1999 | Steenge | 209/584 |
| 5,959,868 | A | * | 9/1999 | Oppliger et al. | 364/478.14 |
| 6,196,936 | B1 | * | 1/2001 | Lohmann | 700/224 |

FOREIGN PATENT DOCUMENTS

| | | | |
|---|---|---|---|
| DE | 19647973 C1 | 11/1996 | B07C/3/10 |
| EP | 0761322 A1 | 3/1997 | |

* cited by examiner

*Primary Examiner*—Donald P. Walsh
*Assistant Examiner*—Joseph Rodriguez
(74) *Attorney, Agent, or Firm*—Van Dyke, Gardner, Linn & Burkhart, LLP

(57) ABSTRACT

A method and apparatus for sorting mail to delivery point sequence includes providing a first sortation assembly adapted to performing a first sort pass to mail articles supplied to it and a second sortation assembly adapted to performing a second sort pass to mail articles supplied to it. Mail articles are supplied to the first sortation assembly which identifies the mail articles and performs a first sort pass to sort the mail articles. The mail sorted by the first sortation assembly is conveyed to the second sortation assembly which performs a second sort pass to sort the mail articles to delivery point sequence depth of sort.

28 Claims, 8 Drawing Sheets

DELIVERY POINT SEQUENCING MAIL SORTING SYSTEM WITH FLAT MAIL CAPABILITY

CROSS-REFERENCE TO RELATED APPLICATION

This application claims priority from U.S. provisional patent application Ser. No. 60/146,689 filed on Aug. 2, 1999.

BACKGROUND OF THE INVENTION

The invention relates generally to an article sorting method and apparatus and, more particularly, to sortation of mail. The invention is especially adapted to sort flat mail to delivery point sequence or carrier walk sequence, but may also apply to a mix of flat mail and letter mail.

Mail is received in a distribution warehouse from typically two sources. One is local mail which is to be delivered within the local area. This is known as turnaround mail. Local mail may also be sorted for delivery to other distribution centers. The other source of mail is out-of-area mail received from other distribution centers. Mail which is to be delivered locally must, ultimately, be sorted to delivery point sequence, also known as "carrier walk sequence." A Dual Bar Code Sequenced (DBCS) machine is capable of achieving delivery point sequence for letter mail. However, it requires two or more passes of the mail through the same sequence. A first depth of sort is achieved with the first pass. The letters are then loaded into trays and the trays loaded onto manual carts. The trays are then unloaded from the manual carts and reprocessed during a second pass. An alternative to manual handling of the trays of mail between passes is disclosed in U.S. Pat. No. 5,385,243 which utilizes a storage and retrieval machine to stage the letter trays for the second pass.

Flat mail is mail which ranges in length of from 5 inches to 15 inches, height of from 6 inches to 12 inches, thickness of from 0.009 inches to 0.75 inches, and weight of from 0.01 pound to 1.0 pound. It may include paper envelopes, plastic wrappers, bound catalogs, banded newspapers, open mail pieces without wrappers, and the like. Such flat mail has traditionally been sorted to the distribution center level automatically, such as utilizing a model AFSM 100 flat sorting system manufactured by Mannesmann Dematic Postal Automation and marketed in the United States by Mannesmann Dematic Rapistan Corp. The sortation from distribution center to carrier walk sequence has traditionally been performed manually utilizing pigeon-hole bins. Such manual sorting of flat mail to the delivery point sequence may take several hours, up to half of the time available for a carrier to deliver his/her route.

It would be desirable to provide a carrier walk sequence for mail, especially for flat mail. It would be most desirable if the carrier walk sequence of flat mail is accomplished irrespective of source or type of the mail. In particular, it would be desirable to be able to sort turnaround mail to carrier walk sequence.

SUMMARY OF THE INVENTION

The present invention provides a method and apparatus for sorting flat articles which is capable of sorting to delivery point sequence. The invention is capable of sorting to delivery point sequence irrespective of the source of the articles.

According to an aspect of the invention, an article sortation apparatus for sorting mail includes a first sortation assembly, a second sortation assembly, and a conveying assembly. The first sortation assembly includes a first induct, a first sortation mechanism which sorts articles from the first induct to a plurality of containers. The second sorting assembly includes a second induct, a second sortation mechanism which sorts articles from the second induct to an output. The conveying assembly conveys containers from the first sortation mechanism to the second induct. The first sortation assembly may be programmed to resolve the address of each article, apply a pseudo identification to the article, which is retained in a control, and sort the article to bins or containers. The second sortation assembly calls for containers from the first sortation assembly in the control by the first sortation assembly in a particular order and carries out a delivery point sequence sortation on the articles in those containers using the information stored in the control by the first sortation assembly. Preferably, the delivery point sequence sortation is to 9 zip code digits and, most preferably, to 11 zip code digits.

A method of sorting mail to delivery point sequence, according to another aspect of the invention, includes providing a first sortation assembly that is adapted to performing a first sort plan to mail articles supplied thereto and a second sortation assembly adapted to performing a second sort plan to mail articles supplied thereto. Mail is supplied to the first sortation assembly identified and sorted to bins or containers. The mail articles sorted by the first sortation assembly are supplied to the second sortation assembly in a particular sequence and sorted to delivery point sequence.

These and other objects, advantages and features of this invention will become apparent upon review of the following specification in conjunction with the drawings.

DESCRIPTION OF THE PREFERRED EMBODIMENT

Figure 1:
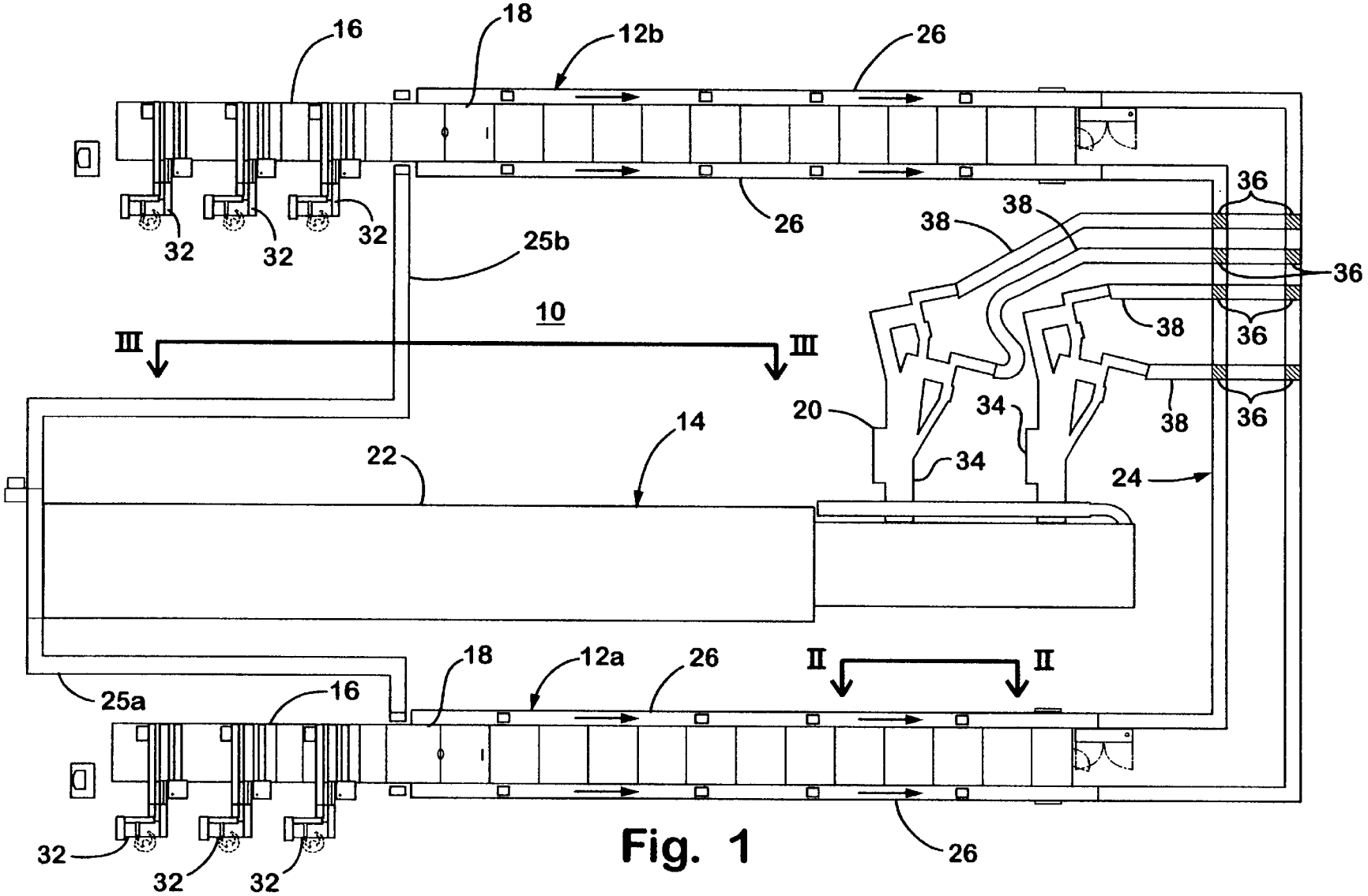
FIG. 1 is a top plan view of a flat article sortation apparatus according to the invention.

Referring now specifically to the drawings, and the illustrative embodiments depicted therein, a flat article sortation apparatus 10 includes primary sort assemblies 12*a* and 12*b* and a delivery point sequence (dps) sort assembly 14. Each sort assembly 12*a*, 12*b* includes an induct 16 and a sortation mechanism generally illustrated at 18. Sortation assembly 14 includes an induct 20 and a sortation mechanism 22. A conveying assembly 24 interconnects outputs 26 of sortation assemblies 12*a*, 12*b* with induct 20 of sortation assembly 14. The purpose of conveying assembly 24 is in order to convey containers of articles sorted by initial sortation assemblies 12*a*, 12*b* to induct 20 in order to induct the sorted containers for further sortation by subsequent sortation assembly 14 in a manner which will described below.

Figure 2:
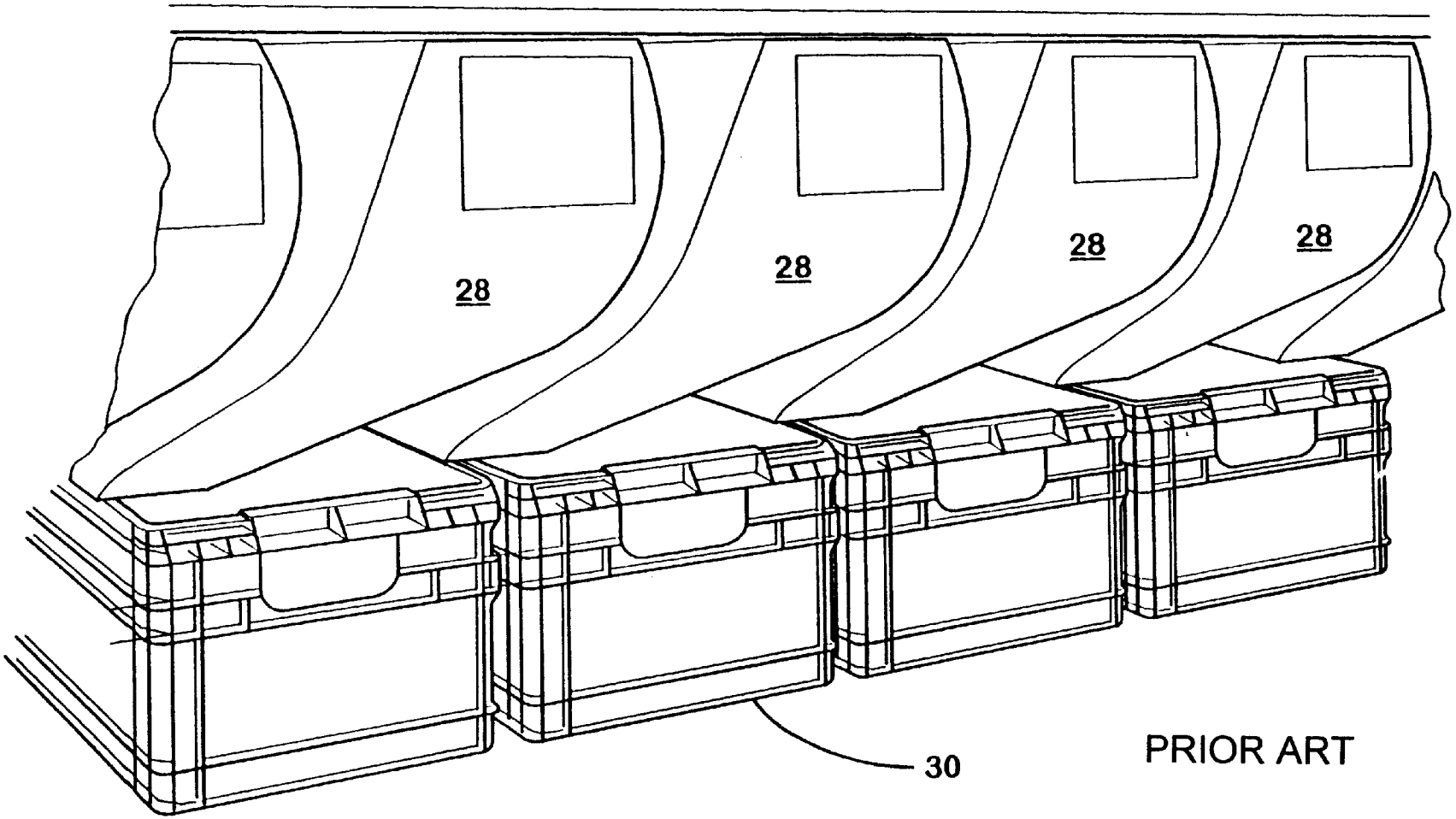
FIG. 2 is a perspective view taken generally along the lines II—II in FIG. 1.
Figure 3:
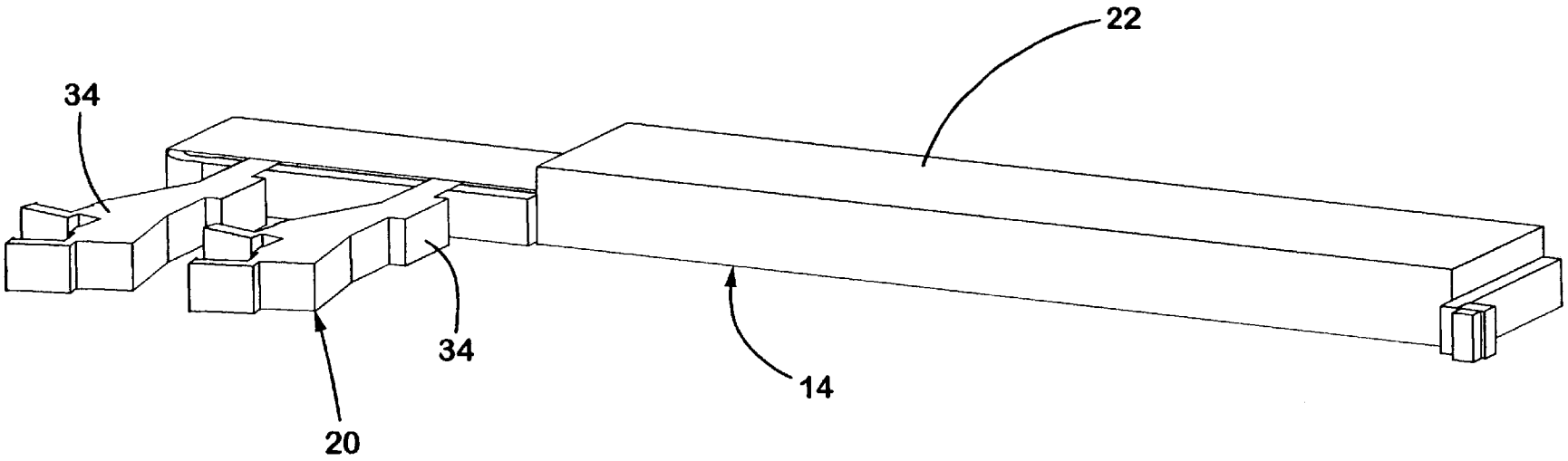
FIG. 3 is a perspective view taken generally from the direction III—III in FIG. 1.
Figure 4:
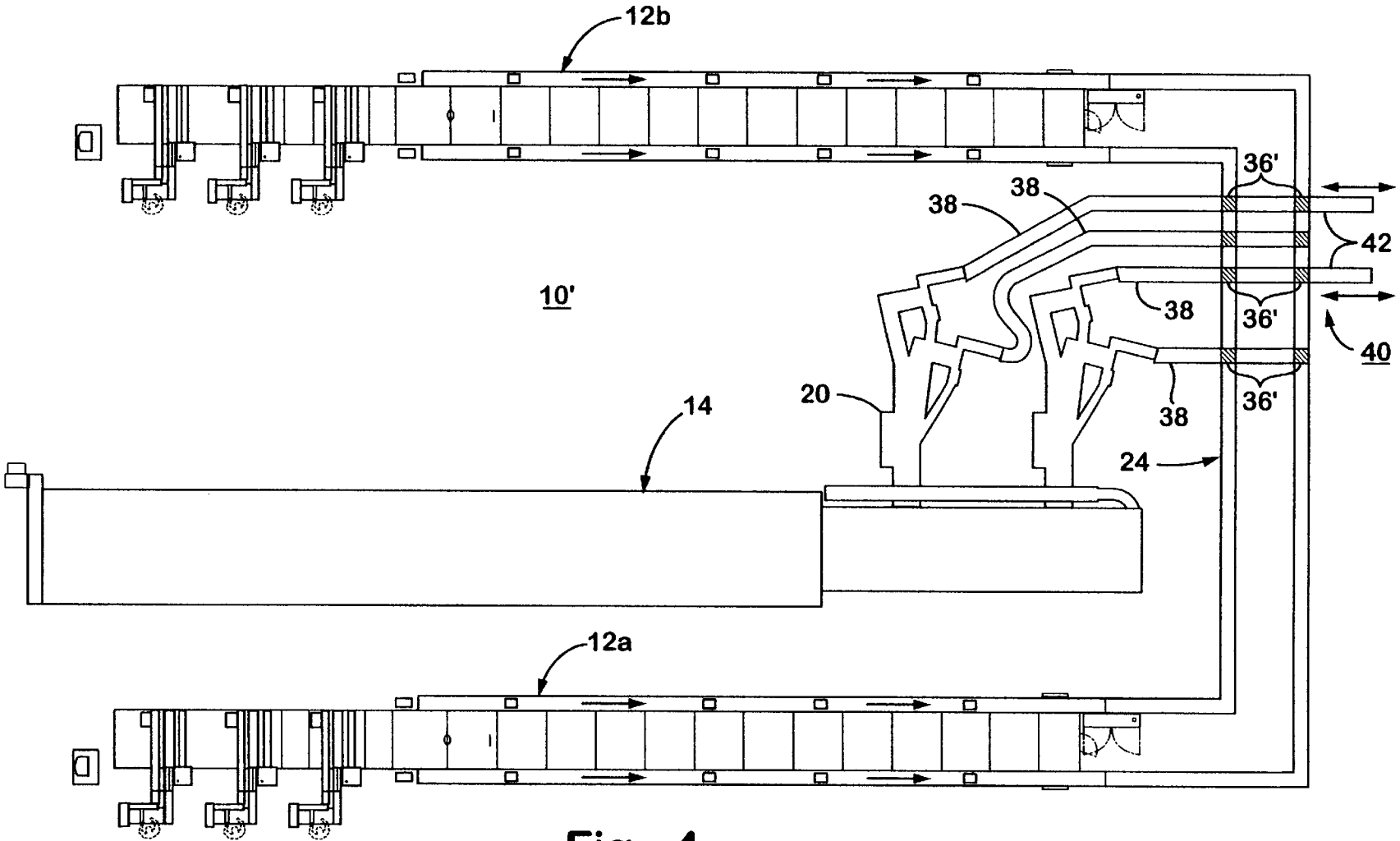
FIG. 4 is the same view as FIG. 1 of an alternative embodiment thereof.
Figure 5:
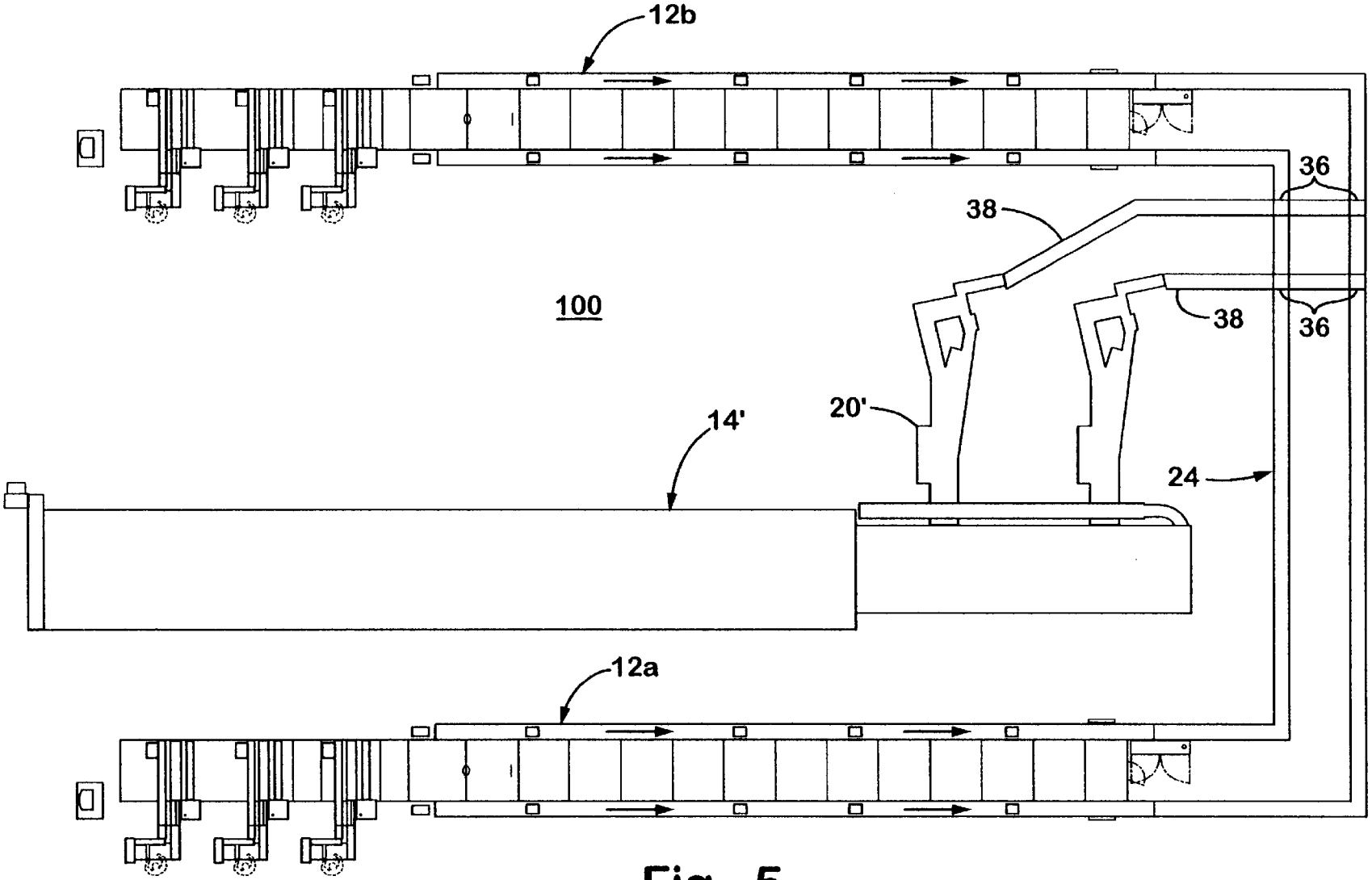
FIG. 5 is the same view as FIG. 1 of another alternative embodiment thereof.
Figure 6:
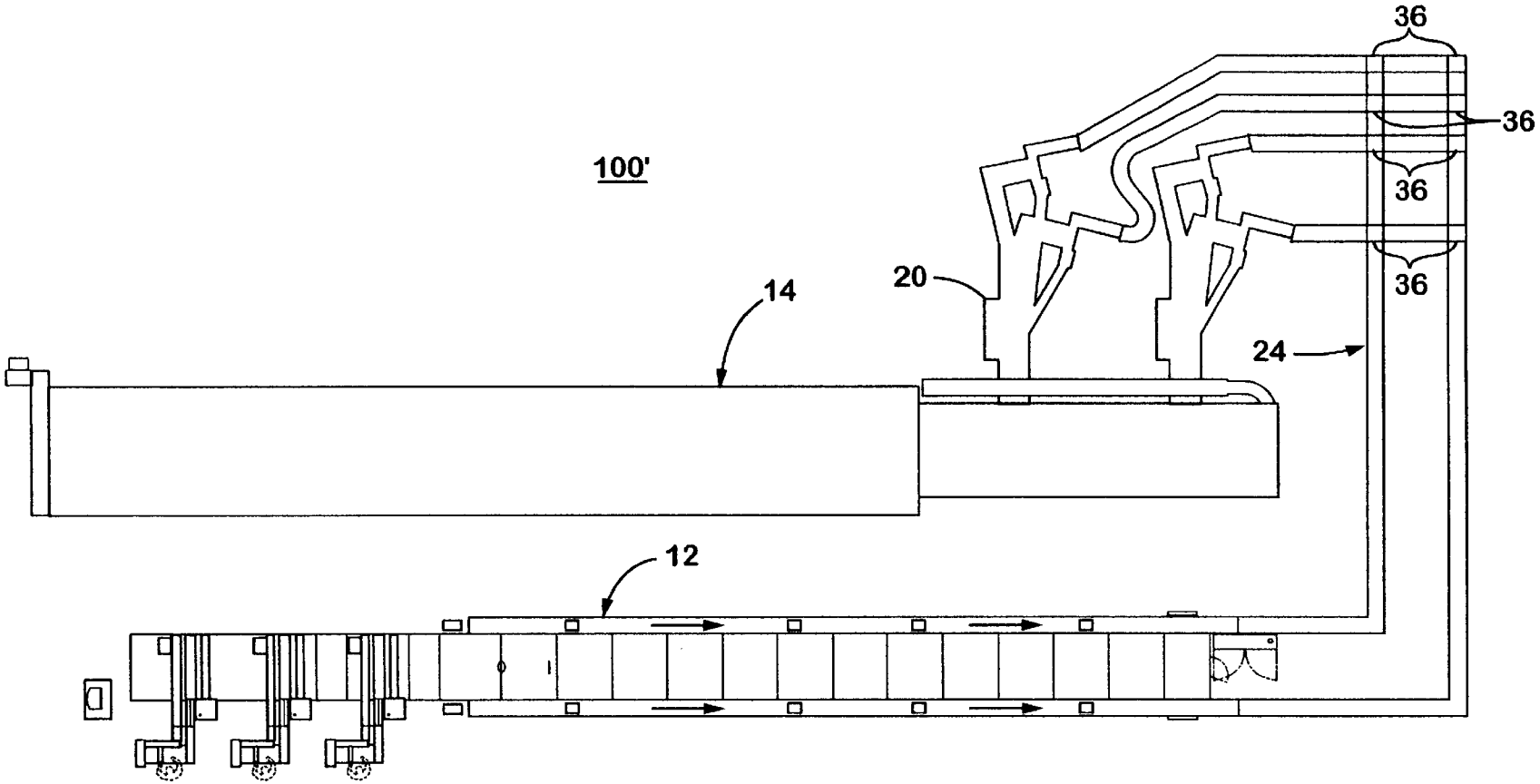
FIG. 6 is the same view as FIG. 1 of yet another alternative embodiment thereof.
Figure 7:
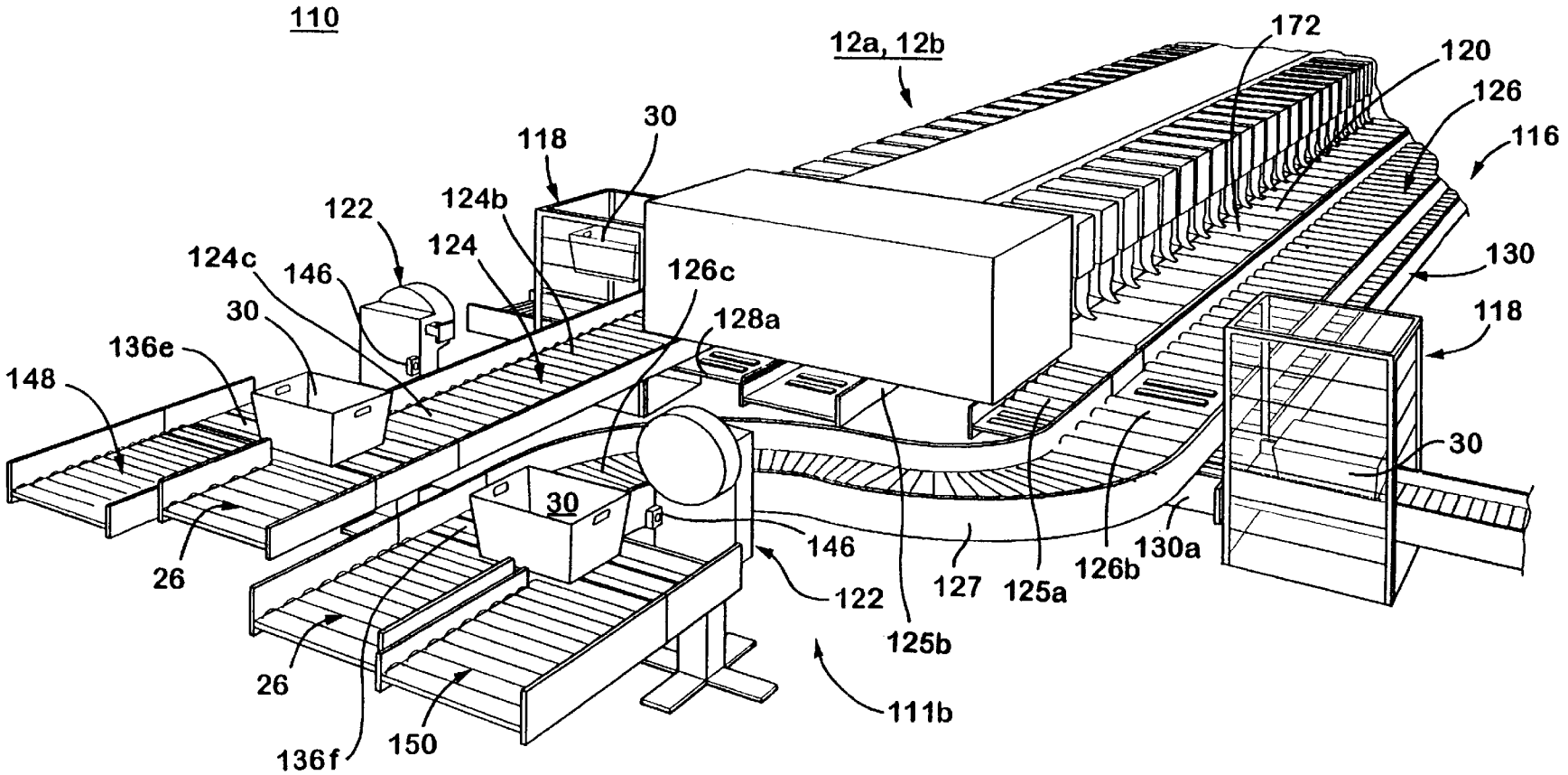
FIG. 7 is a perspective view of a tray handling system useful with the invention.
Figure 8:
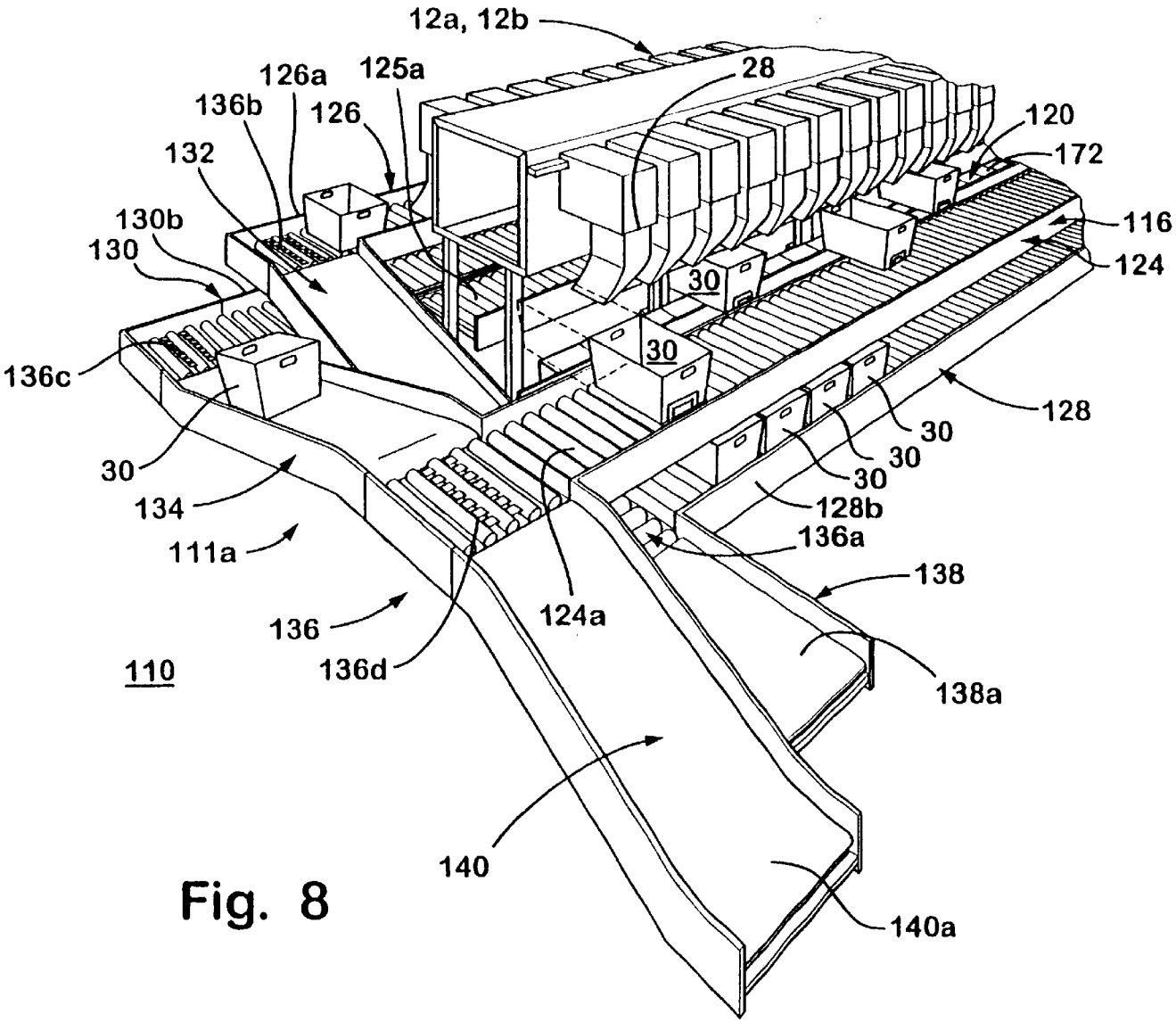
FIG. 8 is a perspective view of the tray handling system in FIG. 7 from an opposite end.

Each sort assembly 12*a*, 12*b* sorts mail received at induct 16. An OCR-Optical Character Reader, VCS Video Coding System (OCR VCS) attempts to resolve the address to the full 11 digit zip code during the first pass on the primary sorting assembly 12*a*, 12*b*. If the OCR/BCR (BCR-Bar Code Reader) cannot resolve the address to 11 digits, the VCS is used to complete the result. The address is resolved to 11 digits during the first pass. This information is retained by a high level sortation computer and used during the first and second pass operations. The OCR/VCS system connects the pseudo number with the 11 digit zip code. The primary sortation assembly 12*a*, 12*b* uses the 11 digit zip code to send the mail piece to the correct output during the first pass, so that it can be fed back through the second pass on dps sortation assembly 14 to the delivery point sequence. The mail piece must be sorted correctly (using the 11 digit zip code) each pass to be correctly sorted. Sortation mechanism 18 includes a carousel (not shown) which deposits articles into particular chutes 28 for depositing in containers 30 positioned under the chutes (FIG. 2). A tray handling system 110 discharges full trays automatically to output 26 which, in the illustrated embodiment, is a conveyor such as a belt conveyor, powered roller conveyor, or the like. A preferred form of tray handling system 110 is illustrated in FIGS. 7 and 8. In the illustrated embodiment, sortation assemblies 12*a*, 12*b* are flat-sorting systems marketed by Alcatel Postal Automation System and/or Mannesmann Dematic Rapistan Corp. under Model AFSM100. In the illustrated embodiment, each induct 16 includes three induct lines 32 and has 120 bin positions but may be extended up to 240 bins.

Therefore, each of the three induct lines 32 is capable of sorting to 40 possible bins. Each sortation assembly 12*a*, 12*b* is preferably capable of sorting up to 10,000 pieces of flat mail per hour and, most preferably, approximately 20,000 pieces of flat mail, or more, per hour.

Sortation assembly 14, in the illustrated embodiment, is a dual-carousel system having 300 bins marketed by Mannesmann Dematic Postal Automation under Model TOPS2000. Mail can be sorted to each of the 300 bins from either of the dual carousels as fed by each of dual induct lines 34. In the illustrated embodiment, details of sortation assembly 14 are disclosed in French Patent Application Nos. 9908610 filed Jul. 5, 1999, by Fabrice Darrou, Vincent Grasswill, Alain Danjaume, entitled Dispositif de convoyage d' objets plats avec un systeme d' aiguillage; 9909163 filed Jul. 15, 1999, by Jean-Luc Astier, Pierre Advani, Dino Selva, entitled Dispositif a plusieurs convoyeurs a godets superposes pour le tri d' objets plats; 9907316 filed Jun. 10, 1999, by Fabrice Darrou, Vincent Grasswill, Robert Vivant, entitled Dispositif de convoyage de courrier avec des roues en matiere elastomere elastiquement deformables; Published International Patent Application WO 00/39010 published Jul. 6, 2000, by Francois Agier et al., entitled DEVICE FOR CONVEYING FLAT OBJECTS BETWEEN PROCESSING EQUIPMENT ITEMS; and Published International Patent Application WO 00/39012 published Jul. 6, 2000, by Francois Agier et al., entitled ROUTING DEVICE FOR GROUPING TWO STREAMS OF FLAT OBJECTS, SUCH AS MAIL ENVELOPES, INTO ONE STREAM; the disclosures of which are hereby incorporated herein by reference. Alternatively, sortation assembly 14 may use the principles disclosed in U.S. Pat. No. 5,718,312 adapted to flat mail sortation capability, the disclosure of which is incorporated herein by reference. Preferably, sortation assembly 14 is capable of sorting up to 20,000 flat articles per hour and, most preferably, up to approximately 40,000 flat articles per hour, or more. Preferably, sortation assembly 14 has a sort rate that is approximately double the sort rate of each sortation assembly 12*a*, 12*b* for reasons that will be set forth in more detail below. A tray return conveyor 25*a*, 25*b* returns empty trays from a dps sortation assembly to a respective primary sortation assembly 12*a*, 12*b*.

As containers, or trays, 30 are dispatched from sortation assemblies 12*a*and 12*b* according to the sort plan, they are conveyed by conveying assembly 24 to induct 20 of sortation assembly 14. Conveying assembly 24 includes a series of transfer switches 36 which selectively transfer containers 30 onto spurs 38 leading to induct 20. Transfer switches 36 are operated in coordination with the overall sortation plan in order to stage containers 30 at induct 20 in a sequence called for by sortation assembly 14. The first pass primary sortation assembly 12*a*, 12*b* is used by the system to determine the address information. The system must learn how many letters are to be sent to each delivery point. The first machine, in addition to discovering address and mail piece information, starts the sorting process. Note that this first pass requires resolution to the delivery point level (11 digits for the US). During the first pass, all of the mail destined for the first delivery point of each route is sent to output 1, the second delivery point to output 2, and the third to output 3, etc. After the first pass is concluded, the trays are then swept automatically from the sortation assembly 12*a*, 12*b* and sent to dps sortation assembly 14, but only when sortation assembly 14 calls for each particular container. For correct delivery point sequencing, output 1 is processed before output 2, which is processed before output 3. During this second pass, mail for a first carrier route will be sent to output 1, mail for another carrier route will be sent to output 2, and mail for yet another carrier route will be sent to output 3. This pass splits mail from the original output 1 (first delivery point regardless of route) between final outputs 1, 2, and 3. The same process is followed for original outputs 2 and 3. The idea is to ensure that the delivery points in the stackers at the end of the first pass are in separate outputs at the end of the second pass.

As would be apparent to the skilled artisan, article sortation assembly 10 is capable of sorting turnaround mail, which is mail collected in a local area in which sortation assembly 10 is located and sorting the mail to the delivery point sequence at the output of sortation assembly 14.

Each piece of mail is identified efficiently (to 11 digits) on the first pass, using OCRJVCS and a spray-on PSEUDO ID#, and sorts the mail in an efficiently balanced throughput scenario of approximately 17,000 pieces/hr (in balance with spray-on system and OCRIVCS delay). The product can now be called for in sequence (and processed) at a higher speed in the second pass (40,000 P/C hr). This allows for substantial reduction in labor and utilizes mail containers or cartridges that allow the efficient and timely input of dps sortation assembly 14. The system maximizes, optimizes and balances the various levels of technology (for product ID, software and VCS delay) and captures the savings by allowing use of a high speed second pass. Various levels of technology may be integrated in an efficient (time-balanced) scenario, which addresses a complex series of process constraints to capture saving previously achievable.

The present invention advantageously utilizes the extremely fast sortation capacity of sortation assembly 14 by supplying articles initially sorted by sortation assemblies 12*a*and 12*b*, each of which has a lower capacity than sortation assembly 14, but, when combined, are capable of supplying containers of first-pass sorted flat articles at a rate that utilizes the capacity of sortation assembly 14. Additionally, mail may be transferred between sortation assemblies 12*a* and 12*b* and sortation assembly 14 in a highly automated manner. This avoids the necessity for loading mail into standard trays and loading the trays on manual carts, also known as Eastern Regional Mail Containers (ERMC). Advantageously, the present invention may utilize containers 30 that are of rigid construction such as rigid molded plastic, or the like, and bearing a permanent identification number which may be encoded by a plate attached to the container, which may be a bar code, radio frequency tag, or the like. This eliminates the necessity for applying temporary labels to each container dispatched from sortation assembly 12*a* and 12*b* as would be done if the containers were being dispatched to the transportation system. Rigid containers are feasible because containers 30 may be retained totally within sortation assembly 10 and not utilized to ship mail to other distribution centers. The utilization of rigid containers advantageously facilitates automatic transfer of flat articles from the containers at induct 20 to thereby further reduce manual processing of the flat articles to be sorted.

Flat articles that have been sorted to delivery point sequence by sortation assembly 10 may be dispatched to a transportation system utilizing the HIGH THROUGHPUT DISPATCH SYSTEM FOR MAIL PROCESSING AND DISTRIBUTION CENTER disclosed in International Application Ser. No. PCT/EP99/00317 filed Jan. 21, 1999, claiming priority from U.S. provisional patent application Ser. No. 60/072,032 filed Jan. 21, 1998, the disclosures of which are hereby incorporated herein by reference. Sortation assembly 10 may also utilize the principles of DOCK-TO-DOCK RECEIVING AND DISPENSING FOR A POSTAL PROCESSING CENTER disclosed in commonly assigned provisional patent application Ser. No. 60/133,413 filed May 11, 1999, the disclosure of which is hereby incorporated herein by reference.

An alternative flat article sortation apparatus 10' includes an input/output assembly 40 for conveyor assembly 24. Input/output assembly 40 includes one or more lanes 42 which may transfer containers from an exterior source, such as a transportation system to feed the containers to induct 20 of sortation system 14. Alternatively, input/output section 40 may transfer containers of flat articles that have been sorted by sortation assemblies 12*a* and 12*b* to a transportation system. This allows sortation assembly 10' to dispatch to the transportation system trays of articles sorted by sortation assemblies 12*a* and 12*b* to the level of dispatch to other distribution/sortation centers. Accordingly, mail received at the distribution center in which sortation assembly 10' is located can be inducted at induct 16 on each sortation assembly 12*a* and 12*b* and sorted to other distribution centers, as will be understood by the skilled artisan. This could be done either separate from or in combination with sorting turnaround mail to delivery point sequence with sortation assembly 14.

Input/output 40 could additionally be utilized to input trays or containers of flat articles received from other distribution centers to be combined with trays of flat articles initially sorted by sortation assemblies 12*a* and 12*b* and finally sorted by sortation assembly 14 to delivery point sequence. This allows the output of sortation assembly 14 to handle both turnaround mail and mail originating from other distribution centers. The mail from other distribution centers could be sorted separately or in combination with locally collected mail in the area surrounding the distribution center in which sortation assembly 10' is located. In sortation assembly 10', conveying assembly 24 would utilize bidirectional transfer switches 36' in order to provide transferring of articles to either induct 20 or to input/output 40 and visa versa. Transfer switches 30, 36' are preferably of the type disclosed in commonly assigned provisional patent application Ser. No. 60/137,785 filed Jun. 4, 1999, entitled CONVEYOR TRANSFER ASSEMBLY, the disclosure of which is hereby incorporated herein by reference.

Preferably, dps sortation assembly 14 is capable of handling both flat articles, such as flat mail, and the smaller letter mail. With such capacity, it may be possible to merge not only flat mail from distribution centers remote from the distribution center in which sortation assembly 10' is located, but also to insert letters such as from other such distribution centers or from other sorters such as a sorter dedicated to sorting letter mail. As such, the mail dispatched from the output of sortation assembly 14 may be integrated into individual bundles of both flat mail and letter mail for each household in order to further maximize the efficiency of each mail carrier while walking the mail route.

An alternative article sortation apparatus 100 is similar to sortation apparatus 10, except that it includes a dps sortation assembly 14' with an induct 20' having only two induct lines 38. By using rigid containers capable of automatic unloading, sortation assembly 14' can be supplied with a sufficient quantity of articles utilizing only two induct lines.

Another alternative article sortation apparatus 100' is shown having a single initial sortation assembly 12 for conducting an initial sort plan on the flat articles and a conveyor assembly 24 supplying the containers of initially sorted flat articles from sortation assembly 12 to dps sortation assembly 14. In the illustrative embodiment, primary sortation assembly 12 has a capacity that is similar to that of subsequent sortation assembly 14. Because the capacities of sortation assemblies 12 and 14 are relatively closely matched, only one primary sortation assembly 12 is supplied.

An example of a tray management system 110 that is useful with the invention is illustrated in FIGS. 7 and 8. However other tray management systems, including ones that are manual or semi-automatic, can be used. Automatic tray handling system 110 includes a plurality of conveying surfaces 116, which are operable to move the trays 30 along one or both sides of the sorter units 12*a*, 12*b*. A plurality of tray moving devices 120 are operable at respective sorter units 12*a*, 12*b* to pull empty trays 30 onto a tray support 172, which supports the empty tray while the sorter system discharges sorted mail into the tray. After the tray is at least partially filled by the sorter unit, the tray moving device 120 is then operable to move the at least partially filled tray back onto the conveying surface. A continuous supply of empty trays is provided to the sorting units 12*a*, 12*b* and filled or at least partially filled trays are automatically discharged from the sorter units onto the conveying surface 116.

An input end 111*a* of tray handling system 110 preferably provides one or more tray induct stations 138 and 140 for loading or inducting empty trays onto the tray handling system, while a discharge end 111*b* of tray handling system 110 provides a downstream operation, such as a labeling station 122 which is operable to label the trays as they are discharged from tray handling system 110 to output 26. The sorter units 12*a*, 12*b* may each be arranged in a pair of rows, and the conveying surfaces 116 of automatic tray handling system 110 may extend around both sides of the rows of each sorter unit 12*a*, 12*b*. However, the tray handling system 110 could be used with a single side of a mail sortation system which has one or more rows of sorter units. Empty trays 30 are movable in a continuous loop via conveying surfaces 116 and a pair of vertical tray moving or tray return devices 118 at one end of the tray handling system.

Conveying surface 116 includes a plurality of conveying surfaces. More particularly, conveying surface 116 preferably includes a pair of opposite upper conveyors 124 and 126, a pair of opposite lower conveyors 128 and 130 and a pair of tray moving or return devices, such as incline or connecting surfaces or ramps 132 and 134, which are operable to move empty trays from lower conveyor 128 to upper conveyor 126 and from lower conveyor 130 to upper conveyor 124, respectively, at input end 111*a*. A pop up belt transfer or 90 degree transfer 136 is positioned at each end of the incline ramps 132 and 134 to change the direction of travel of the trays 30 as they move from one of the lower conveyors to the respective incline ramp, and from the incline ramp to the respective upper conveyor. Such transfer units are commercially available and known in the art, such that a detailed discussion will not be included herein. Briefly, transfer units 136 are operable to convey a tray in a direction along the conveyor at which they are positioned, and may be operable to raise one or more belt conveyor strips to convey a tray positioned at the transfer unit in a direction which is generally transverse or normal to the conveyor direction.

Tray induct stations 138 and 140 are preferably positioned side by side one another. Preferably, tray induct stations 138 and 140 preferably include belt conveyors, which are operable to transport or convey an empty tray onto a corresponding 90 degree transfer unit 136*a* and 136*d*, respectively. Empty trays may be manually loaded onto the induct stations to induct the empty trays into the conveyor system 116 of the automatic tray handling system 110 or may be automatically fed from a tray return conveyor 125*a*, 125*b*. Preferably, tray induct station 140 includes an inclined belt conveyor, such that an input end 138*a* and 140*a* of the induct stations 138 and 140, respectively, are positioned at substantially the same level for easy access and loading of empty trays onto the induct stations 138 and 140.

Incline ramp 132 is connected between a pair of 90 degree transfer units 136*a* and 136*b* at a downstream end 128*b* of lower conveyor 128 and an upstream end 126*a* of upper conveyor 126, respectively. Similarly, incline ramp 134 is connected between a pair of 90 degree transfer units 136*c* and 136*d* at a downstream end 130*b* of lower conveyor 130 and an upstream end 124*a* of upper conveyor 124, respectively.

Trays 30 are conveyed along upper conveying surfaces 124 and 126 toward a downstream end 124*b* and 126*b*, respectively. Vertical tray moving devices 118 are positioned near or at the downstream ends 124*b* and 126*b* to remove empty trays 30 from the upper conveyors and move the empty trays onto an upstream end 128*a* and 130*a* of the lower conveyors 128 and 130, respectively, as discussed in detail below. Labeling stations 122 may be positioned at or near a discharge end 124*c* and 126*c* of upper conveyors 124 and 126, respectively, and are operable to label the filled trays as they are conveyed toward output 26 of automatic tray handling system 110. Preferably, one or both of the upper conveyor surfaces included a curved section 127, such that the discharge ends 124*c* and 126*c* of upper conveyors 124 and 126, respectively, are in close proximity, in order to reduce the manual labor of the system. A scanner 146 may be positioned at output 26 to verify the information contained on the label applied to the trays. A pair of reject conveyors 148 and 150 may be provided adjacent to discharge ends 124*c* and 126*c*, respectively, to allow incorrectly labeled trays to be discharged to a separate area via respective 90 degree transfer units 136*e* and 136*f* and reject conveyors 148 and 150.

Lower conveyors 128 and 130 are preferably operable in a reverse direction from upper conveyors 124 and 126, to return the empty trays 30 back toward input end 111*a*. The 90 degree transfer units 136*a* and 136*c* are positioned at downstream ends 128*b* and 130*b* of conveyors 128 and 130, respectively, to move the empty trays onto the respective incline ramps 132 and 134 to transport the trays to the upper conveyors 124 and 126, respectively, at the other side of the sortation system 13.

In order to provide a continuous loop for the empty trays about the conveyor surfaces 116, vertical tray moving devices 118 are positioned at downstream ends 124*b*, 126*b* of upper conveyors 124, 126 and upstream ends 128*a*, 130*a* of lower conveyors 128, 130. Each vertical tray moving device 118 is operable to move an empty tray from the respective upper conveyor 124, 126, lower the tray to the level of the lower conveyors 128, 130, and then move the tray onto the respective lower conveyor 128, 130.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows:

1. A flat article sortation apparatus for sorting flat articles, comprising:

a first sorting assembly comprising a first induct, a first sortation mechanism sorting articles from said first induct to a plurality of containers;

a second sorting assembly comprising a second induct, a second sortation mechanism sorting articles from said second induct to an output; and a conveying assembly operable to convey containers from said first sortation mechanism to said second induct such that the conveyed containers are provided at said second induct in a sequence called for by said second sorting assembly, wherein said conveying assembly comprises at least one outbound conveying line from said first sortation mechanism, at least one inbound conveying line to said second induct, and at least one transfer mechanism from said at least one outbound conveying line to said at least one inbound conveying line.

2. The sortation apparatus in claim 1, wherein said first sorting assembly includes a converter for converting an address to a delivery point sequence zip code and an applicator to apply a pseudo identification code to each article.

3. The sortation apparatus in claim 2 wherein said converter comprises at least one of an optical character reader and a video coding system.

4. The sortation apparatus in claim 2 including a sortation computer storing said pseudo codes and sequencing containers from a first pass through said first sorting assembly to a second pass through said second sorting assembly.

5. The sortation apparatus in claim 1, herein said second sorting assembly has substantially twice the article-sorting capacity of said first sorting assembly.

6. The sortation apparatus in claim 1, wherein said conveying assembly includes a container return from said second sorting assembly to said first sorting assembly, said container return being operable to convey empty containers from said second sorting assembly to said first sorting assembly.

7. The sortation apparatus in claim 1 wherein at least one of said conveying lines comprises a plurality of conveying lines and said at least one transfer mechanism comprises a plurality of conveying mechanisms, said apparatus including a control which is operable to control said plurality of transfer mechanisms.

8. The sortation apparatus in claim 1 wherein said at least one outbound conveying line comprises a plurality of outbound conveying lines, said at least one inbound conveying line comprises a plurality of inbound conveying lines and said at least one transfer mechanism comprises a plurality of transfer mechanisms, wherein containers from any of said outbound conveying lines can be supplied to any one of said input conveying lines via said plurality of transfer mechanisms.

9. The sortation apparatus in claim 1, wherein said first induct comprises a plurality of induct assemblies.

10. The sortation apparatus in claim 1, wherein said second induct comprises a plurality of induct assemblies.

11. A flat article sortation apparatus for sorting flat articles, comprising:

a first sorting assembly comprising a first induct, a first sortation mechanism sorting articles from said first induct to a plurality of containers;

a second sorting assembly comprising a second induct, a second sortation mechanism sorting articles from said second induct to an output; and a conveying assembly operable to convey containers from said first sortation mechanism to said second induct such that the conveyed containers are provided at said second induct in a sequence called for by said second sorting assembly, wherein said conveying assembly includes an input for receiving out-of-area articles received from other article sortation facilities and supplying the out-of-area articles to said second induct.

12. A flat article sortation apparatus for sorting flat articles, comprising:

a first sorting assembly comprising a first induct, a first sortation mechanism sorting articles from said first induct to a plurality of containers;

a second sorting assembly comprising a second induct, a second sortation mechanism sorting articles from said second induct to an output; and a conveying assembly operable to convey containers from said first sortation mechanism to said second induct such that the conveyed containers are provided at said second induct in a sequence called for by said second sorting assembly, wherein said conveying assembly includes an output for dispatching articles sorted by said first sortation assembly as out-of-area articles to be supplied to other sortation facilities.

13. A method of sorting mail to delivery point sequence, comprising:

providing a first sortation assembly for performing a first sort pass to mail articles supplied thereto and a second sortation assembly for performing a second sort pass to mail articles supplied thereto;

providing a conveying system for automatically conveying articles from said first sortation assembly to said second sortation assembly;

supplying mail articles to said first sortation assembly;

identifying the mail articles and performing said first sort pass to sort said mail articles;

conveying said mail sorted by said first sortation assembly to said second sortation assembly in a sequence called for by said second sortation assembly, wherein said conveying system comprises a plurality of outgoing lanes leading from said first sortation assembly, a plurality of incoming lanes leading to said second sortation assembly and transfer switches between each of said outgoing and incoming lanes, said method further including operating said switches to transfer said containers between particular ones of said outgoing lanes and particular ones of said incoming lanes; and performing said second sort pass to sort said mail articles to a carrier route sequence depth of sort.

14. The method of sorting mail of claim 13, wherein supplying mail articles to said first sortation assembly comprises supplying turnaround mail to said first sortation assembly.

15. The method of sorting mail of claim 13, wherein supplying mail articles comprises supplying flat mail.

16. The method of sorting mail of claim 13, wherein providing a first sortation assembly comprises providing a plurality of first sortation assemblies, each having a throughput that is substantially less than the throughput of said second sortation assembly.

17. The method of sorting mail of claim 13, wherein providing a first sortation assembly comprises supplying two of said first sortation assemblies, each having a throughput that is approximately one-half the throughput of said second sortation assembly.

18. The method of sorting mail of claim 13, wherein conveying said mail comprises transporting mail in containers.

19. A method of sorting mail to delivery point sequence, comprising:

providing a first sortation assembly for performing a first sort pass to mail articles supplied thereto and a second sortation assembly for performing a second sort pass to mail articles supplied thereto;

providing a conveying system for automatically conveying articles from said first sortation assembly to said second sortation assembly supplying mail articles to said first sortation assembly;

identifying the mail articles and performing said first sort pass to sort said mail articles;

conveying said mail sorted by said first sortation assembly to said second sortation assembly in a sequence called for by said second sortation assembly, wherein said conveying system includes an input, said method further including supplying out-of-area mail received from other article sortation facilities to said input and conveying the out-of-area mail to said second sortation assembly; and performing said second sort pass to sort said mail articles to a carrier route sequence depth of sort.

20. The method of sorting mail of claim 19 further including conveying said out-of-area mail to said second sortation assembly using said conveying system.

21. A method of sorting mail to delivery point sequence, comprising:

providing a first sortation assembly for performing a first sort pass to mail articles supplied thereto and a second sortation assembly for performing a second sort pass to mail articles supplied thereto;

providing a conveying system for automatically conveying articles from said first sortation assembly to said second sortation assembly supplying mail articles to said first sortation assembly;

identifying the mail articles and performing said first sort pass to sort said mail articles;

conveying said mail sorted by said first sortation assembly to said second sortation assembly in a sequence called for by said second sortation assembly, wherein said conveying system comprises an output, said method further including conveying mail sorted by said first sortation assembly to said output as out-of-area mail and dispatching said out-of-area mail to other sortation facilities; and performing said second sort pass to sort said mail articles to a carrier route sequence depth of sort.

22. A method of sorting mail to delivery point sequence, comprising:

identifying mail articles;

performing a first sort pass to said mail articles to containers of mail articles;

conveying said containers of mail articles sorted by said first sort pass with a conveying assembly to a second sort pass in a sequence called for by said second sort pass, wherein conveying said mail articles includes conveying said containers of said mail articles via a plurality of conveying lanes and a plurality of transfer switches positioned between an output of said first sort pass and an input to said second sort pass; and performing said second sort pass to sort said mail articles to a carrier route sequence depth of sort.

23. The method of claim 22, wherein performing a first sort pass includes performing a first sort pass at a first sortation assembly.

24. The method of claim 23, wherein performing said second sort pass includes performing said second sort pass at a second sortation assembly.

25. The method of claim 22, wherein said plurality of conveying lanes comprise a plurality of outgoing lanes leading from said output of said first sort pass and a plurality of incoming lanes leading to said input to said second sort pass.

26. The method of claim 25, wherein said transfer switches are positioned between each of said outgoing and incoming lanes.

27. The method of claim 26 including operating said transfer switches to transfer said containers of said mail articles between particular ones of said outgoing lanes and particular ones of said incoming lanes.

28. The method of claim 22, including conveying empty containers from a discharge of said second pass to an induct of said first pass.

* * * * *

UNITED STATES PATENT AND TRADEMARK OFFICE

CERTIFICATE OF CORRECTION

PATENT NO. : 6,501,041 B1 
DATED : December 31, 2002
INVENTOR(S) : Gary P. Burns and Douglas E. Olson It is certified that error appears in the above-identified patent and that said Letters Patent is hereby corrected as shown below:

Column 4,
Line 48, "OCRJVCS" should be -- OCR/VCS --
Line 51, "OCRIVCS" should be -- OCR/VCS --

Column 8,
Line 62, "herein" should be -- wherein --

Column 11,
Line 1, insert -- ; -- after "assembly"
Line 1, "supplying mail articles to" should be at beginning of line 2 before "said first sortation assembly"

Signed and Sealed this

Twenty-third Day of December, 2003

JAMES E. ROGAN
*Director of the United States Patent and Trademark Office*